US010610998B2

(12) United States Patent
Nash

(10) Patent No.: US 10,610,998 B2
(45) Date of Patent: Apr. 7, 2020

(54) SLURRY BLASTING ASSEMBLY

(71) Applicant: Greener Blast Technologies, Inc., Tyngsborough, MA (US)

(72) Inventor: Robert F. Nash, Tyngsborough, MA (US)

(73) Assignee: Greener Blast Technologies, Inc., Tyngsborough, MA (US)

( * ) Notice: Subject to any disclaimer, the term of this patent is extended or adjusted under 35 U.S.C. 154(b) by 0 days.

(21) Appl. No.: 15/069,328

(22) Filed: Mar. 14, 2016

(65) Prior Publication Data

US 2016/0193715 A1 Jul. 7, 2016

Related U.S. Application Data

(63) Continuation of application No. PCT/US2014/055825, filed on Sep. 16, 2014.

(60) Provisional application No. 61/878,774, filed on Sep. 17, 2013.

(51) Int. Cl.
*B24C 7/00* (2006.01)
*B24C 9/00* (2006.01)

(52) U.S. Cl.
CPC ..... *B24C 7/0084* (2013.01); *B24C 7/00* (2013.01); *B24C 9/00* (2013.01)

(58) Field of Classification Search
None
See application file for complete search history.

(56) References Cited

U.S. PATENT DOCUMENTS

| | | | |
|---|---|---|---|
| 1,877,255 | A | 9/1932 | Sammis |
| 2,825,542 | A | 3/1958 | Jackson |
| D223,510 | S | 4/1972 | Racca et al. |
| 4,439,073 | A | 3/1984 | White |
| 5,024,029 | A | 6/1991 | Abbott et al. |
| 5,135,394 | A | 8/1992 | Hakamatsuka et al. |
| 5,325,639 | A | 7/1994 | Kuboyama et al. |
| 5,575,705 | A | 11/1996 | Yam |
| 5,827,114 | A | 10/1998 | Yam et al. |
| D420,973 | S | 2/2000 | Kalarney |
| 6,582,442 | B2 | 6/2003 | Simon et al. |
| D552,637 | S | 10/2007 | Dore |
| D614,213 | S | 4/2010 | Martinez |
| 7,707,961 | B2 | 5/2010 | Alexander et al. |
| 8,066,549 | B2 | 11/2011 | Voges |
| 8,074,331 | B2 | 12/2011 | Voges |
| D669,922 | S | 10/2012 | Eliason |
| D706,317 | S | 6/2014 | Eliason |
| 8,764,513 | B1 | 7/2014 | Spears |

(Continued)

FOREIGN PATENT DOCUMENTS

WO 2015042032 A1 3/2015

OTHER PUBLICATIONS

International Search Report and Written Opinion issued in corresponding International Application No. PCT/US2014/055825, dated Dec. 15, 2014.

*Primary Examiner* — Brian D Keller

(57) ABSTRACT

A slurry blasting system includes a blasting pot for containing a slurry, and which is directly connected to a pressurized air piping system with a sweep elbow, an eccentric reducer, a ball valve, and a hose shutoff valve. Water is supplied to the blasting pot from a reservoir by a pump. Control valves control the pressure in the air piping system and the pressure in the blasting pot.

3 Claims, 5 Drawing Sheets

(56) References Cited

U.S. PATENT DOCUMENTS

| | | | | |
|---|---|---|---|---|
| D747,375 | S | 1/2016 | Nash | |
| 2008/0287039 | A1 | 11/2008 | Connelly | |
| 2011/0053464 | A1 | 3/2011 | Fowler, III | |
| 2012/0007354 | A1* | 1/2012 | Doig ..... | B65G 53/523<br>285/119 |
| 2012/0015592 | A1 | 1/2012 | Eliason | |

* cited by examiner

Operation:
Each individual Air Pressure Regulator is set to a specific air pressure
Regulator Selector Control Switch assembly enables a specific Air Pressure Regulator
The Individual set pressure when enabled, controls the Blow Pressure pilot regulator air

SLURRY BLASTING ASSEMBLY

CROSS-REFERENCE TO RELATED APPLICATIONS

This application is a continuation of PCT Application No. PCT/US2014/055825 filed Sep. 16, 2014, and published in the English language as PCT Publication No. WO 2015/042032 on Mar. 26, 2015. The PCT Application claims priority to U.S. Provisional Application No. 61/878,774, filed on Sep. 17, 2013. These documents are hereby incorporated herein by reference in their entirety for all purposes.

FIELD OF THE INVENTION

Aspects of this invention relate generally to a slurry blasting assembly, and, in particular, to a slurry blasting assembly with improved throughput, efficiency, and safety.

BACKGROUND

Slurry blasting systems, or abrasive blasting systems, are used to propel a stream of abrasive material under pressure. An abrasive media is mixed with water and a pressurized fluid, e.g., air, to create a high pressure blast stream. The propelled abrasive material can be used to clean contaminated surfaces, remove coatings from surfaces, or apply coatings to surfaces. It can also be used to alter the shape of a surface; e.g., make a rough surface smoother, or make a smooth surface rougher.

When blasting a surface, the composition of the propelled blast stream can greatly affect the performance of the system. The relative amounts of abrasive material, water, and air in the propelled media stream need to be controlled to produce an effective spray at a desired output pressure.

Known abrasive blasting systems use a blast pot having a conical or frusto-conical bottom in which a slurry of water and abrasive material is contained. The slurry exits the pot and travels through piping where it is joined by a stream of compressed air. The blast stream then exits the piping through a blast nozzle, from which it is directed onto the surface to be treated.

It would be desirable to provide a slurry blasting assembly that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY OF THE INVENTION

The principles of the invention may be used to provide a slurry blasting assembly with an improved configuration, thereby resulting in increased efficiency, safety, and throughput. These and additional features and advantages disclosed here will be further understood from the following detailed disclosure of certain embodiments.

Figure 1:
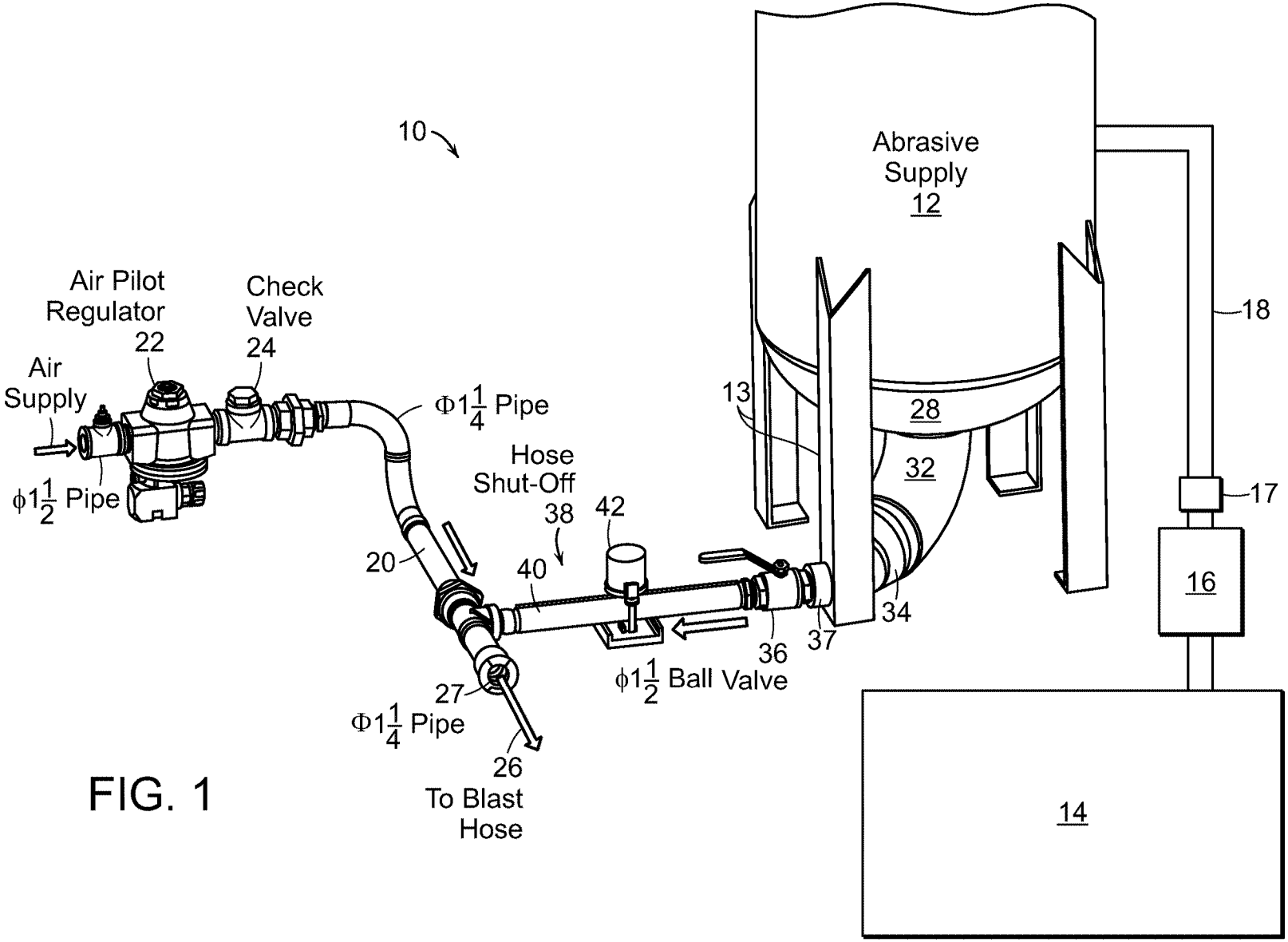
FIG. 1 is a perspective view of a slurry blasting assembly.

The figures referred to above are not drawn necessarily to scale, should be understood to provide a representation of particular embodiments of the invention, and are merely conceptual in nature and illustrative of the principles involved. Some features of the slurry blasting assembly depicted in the drawings have been enlarged or distorted relative to others to facilitate explanation and understanding. The same reference numbers are used in the drawings for similar or identical components and features shown in various alternative embodiments. Slurry blasting assemblies as disclosed herein would have configurations and components determined, in part, by the intended application and environment in which they are used.

DETAILED DESCRIPTION

Figure 2:
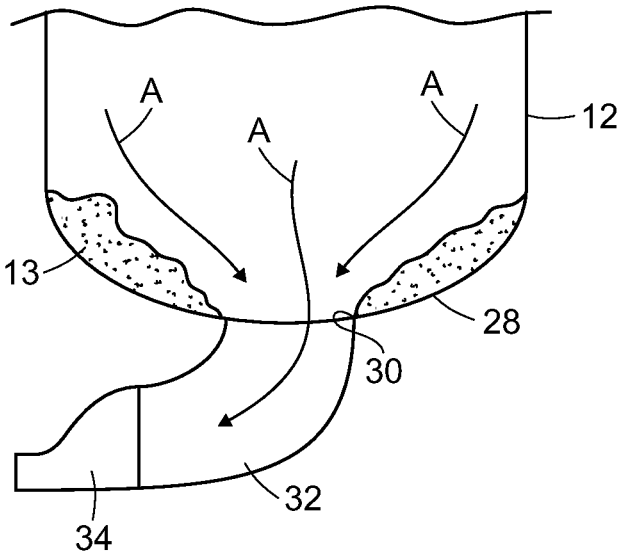
FIG. 2 is a schematic section view of a portion of the blasting pot and piping system of the slurry blasting assembly of FIG. 1.
Figure 3D:
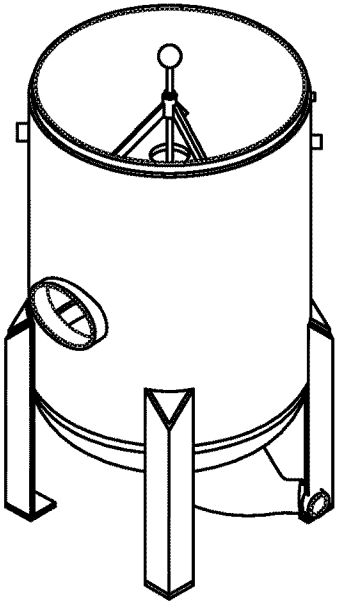
FIGS. 3A-D are perspective and section views of the blasting pot of slurry blasting assembly of FIG. 1.
Figure 3C:
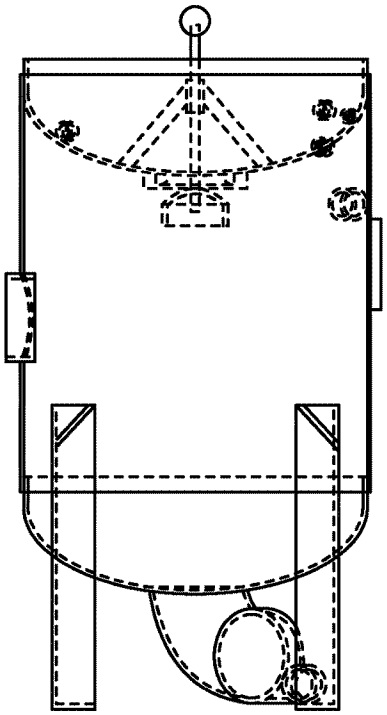
Figure 3A:
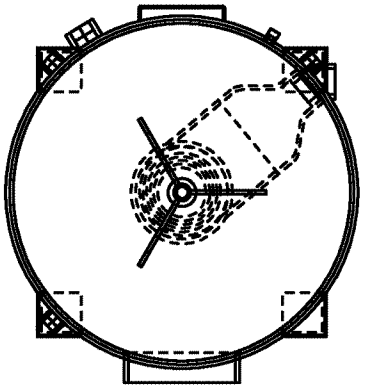
Figure 3B:
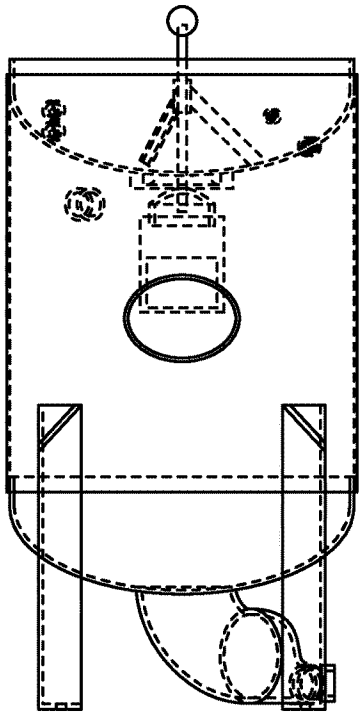

A slurry blasting assembly 10 is depicted in FIGS. 1-3 and can be used for various purposes including cleaning a contaminated surface, removing a coating from a surface, and applying a coating to as surface. Other applications for which slurry blasting assembly 10 can be used will be readily apparent to those skilled in the art, given the benefit of this disclosure.

Slurry blasting assembly 10 includes a blasting pot 12 that contains a slurry, formed of blast media 13 (seen in FIG. 2) and water. Blasting pot 12 may be supported on legs 13. In certain embodiments, blasting pot 12 may be formed of galvanized steel. Blasting pot 12 may also be powder coated. Pressurized water is introduced into blasting pot 12 from reservoir 14. A water pump 16 directs water from reservoir 14 through piping 18 into blasting pot 12. A pressure control valve 17 is used to produce a desired pressure for the slurry contained within blasting pot 12.

Any desired blast media can be used in slurry blasting assembly 10. Exemplary materials for blast media 13 include, but are not limited to, glass beads, aluminum oxide, garnet, jet mag, ceramic shot, steel shot, silicon carbide, and recycled glass.

The slurry exits blasting pot 12 and is introduced into an airstream traveling though air piping 20. The pressure of air in air piping 20 is controlled by an air pressure regulating valve 22, such as an air piloted regulator. A check valve 24 may be positioned downstream of valve 22. In certain embodiments, the amount of air provided through air piping 20 may range from approximately 375 cfm to approximately 1500 cfm.

The pressurized slurry combines with the pressurized air to form a blast stream 26 that exits slurry blasting assembly 10 at an outlet port 27. A hose or other conduit may be connected to outlet port 27 to direct blast stream 26 to a blast nozzle (not shown here) or other suitable spraying members in order to apply blast stream 26 to a desired surface. The blast nozzle or other applicator may have a trigger or any other well-known control mechanism operable to control the flow of the blast stream 26 onto the target surface.

As seen in FIGS. 1, 2, and 3A-D, a bottom 28 of blasting pot 12 is curved, and lacks any linear surfaces. In certain embodiments, the shape of bottom 28 may be hemispherical, elliptical, oval, or any other desired curved or rounded non-linear shape. As seen schematically in FIG. 2, rounded bottom 28 advantageously allows some of blasting media 13 to settle on the upper surface of bottom 28 of blasting pot 12. This helps to prevent the pressurized water that is introduced into blasting pot 12 from cascading down the internal walls of blasting pot 12, which can produce an excessively wet slurry exiting blasting pot 12. As seen here, the presence of blasting media 13 on the upper surface of bottom 28 of blasting pot 12 tends to direct the flow of water and slurry toward the center of pot 2 in the direction of arrows A.

The slurry exits blasting pot 12 through an aperture 30 formed in bottom 28 and then enters a sweep elbow 32. Using sweep elbow 32 with its long radius helps to reduce flow resistance and solids deposition as the slurry exits blasting pot 12. In certain embodiments, blasting pot 12 has a diameter of 24" and sweep elbow 32 has a 6" diameter. The relatively large size of sweep elbow 32 as compared to the diameter of blasting pot 12 helps to improve throughput of the slurry exiting blasting pot 12.

The slurry travels from sweep elbow 32 directly into an eccentric reducer 34 that is attached to sweep elbow 32. In certain embodiments, eccentric reducer 34 transitions from a 6" diameter to a 2" diameter. Eccentric reducer 34 can help prevent the build-up of air bubbles in the system.

Eccentric reducer 34 is connected to a valve 36, such as ball valve 36, with a 45 degree threaded fitting 37. Ball valve 36 is in turn directly connected to a control valve 38, such as hose shutoff 38, that is used to control the flow of slurry out of blast pot 12. In the illustrated embodiment, hose shutoff 38 includes a length of hose 40, formed of rubber or other flexible material, and a valve member 42 for closing and opening hose 40.

Hose shutoff 38 is directly connected to air piping 20. By directly connecting blasting pot 12 to elbow 32, elbow 32 to reducer 34, reducer 34 to ball valve 36 with fitting 37, ball valve 36 to hose shutoff 38, and hose shutoff 38 to air piping 20, the distance that the slurry has to travel between blasting pot 12 and the airstream in air piping 20 is reduced, thereby increasing the efficiency of the system. Further, such a system eliminates much of the piping and/or hosing used in many systems to connect these various parts, which significantly reduces the friction that the slurry encounters as it travels through the system. That is, the slurry travels to air piping 20 through sweep elbow 32, reducer 34, ball valve 36, fitting 37, and hose shutoff 38; a path that is free of any conduit or element other than those five elements.

As seen in FIG. 1, in certain embodiments, ball valve 36, shutoff 38 and the portion of air piping 20 connected to shutoff 38, as well as the outlet 26 are all positioned in substantially the same plane, proximate the bottom of slurry blasting assembly 10. Positioning these elements at this level enhances the safety of slurry blasting assembly 10, as it provides for the high pressure slurry exiting the assembly to come out at a low level, typically near the ankles or shins of a user. This enhances the safety of the system, as it places blast stream 26 in a safer position as it exits slurry blasting assembly 10.

Figure 4:
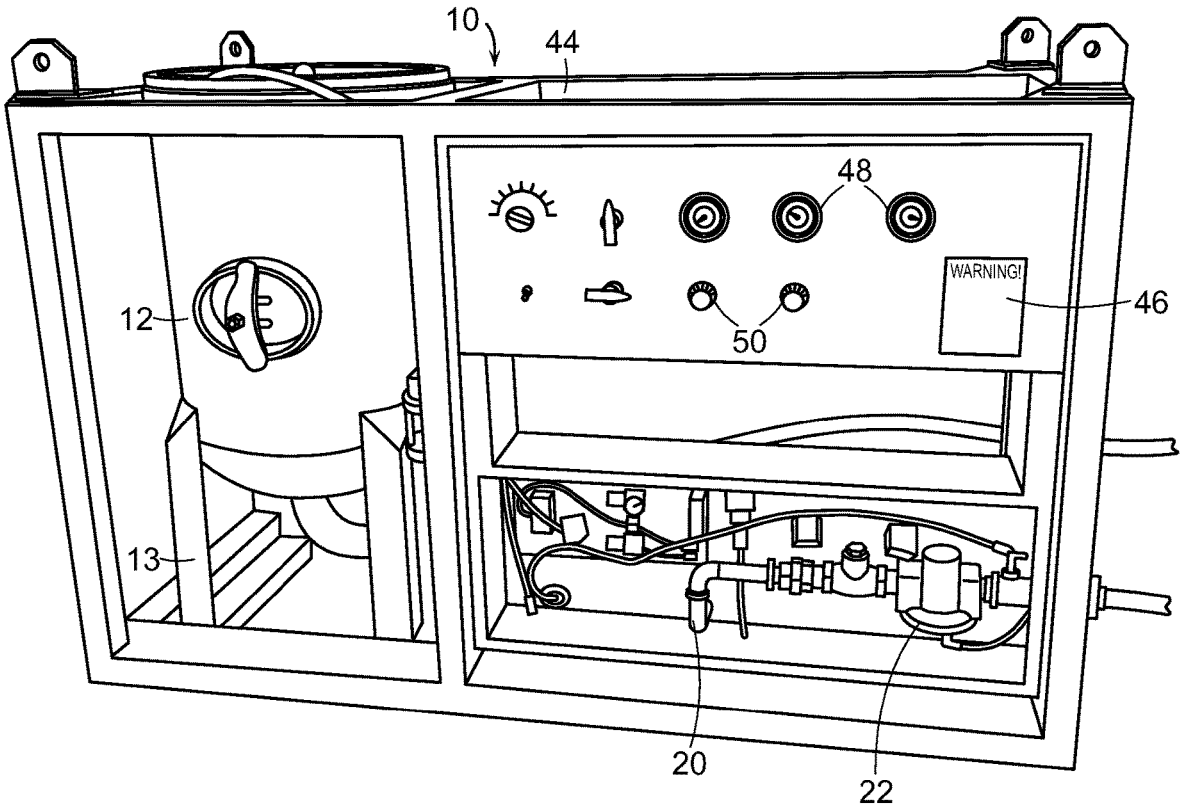
FIG. 4 is a perspective view the slurry blasting assembly of FIG. 1 positioned in a frame.

Slurry blasting assembly 10 is seen in FIG. 4 mounted in a frame 44. A control panel 46 is mounted on frame 44, and includes pressure indicators 48 as well as pressure regulating dials 50, which are used to select desired pressures for the air pressure and pressure in blasting pot 12. Pressure regulating dials 50 send signals to control valve 17 and air pressure regulating valve 22.

In order to introduce the slurry into the air stream, there needs to be a pressure differential between the slurry and the air stream into which it is to introduced. In certain embodiments, the pressure of the slurry in blasting pot is approximately 30 psi greater than that of the air stream. Thus, for example, the pressure of the slurry within blast pot 12 may be set with control valve 17 to be approximately 50 psi, while the air pressure is set with air pressure regulating valve 22 to be approximately 20 psi, providing an outlet pressure for blast stream 26 of approximately 25-30 psi. It is to be appreciated that the required pressure differential between the pressure in blast pot 12 and the air pressure in air piping 20 can vary, and its value depends on various factors including, for example, the type of blast media used as well as the size of the blast media. It is to be appreciated that the user can adjust the pressure of each of the slurry and the air stream to any desired level to produce a desired output pressure for blast stream 26. In certain embodiments, the outlet pressure of blast stream 26 may range from approximately 15 psi to approximately 100 psi.

Figure 5:
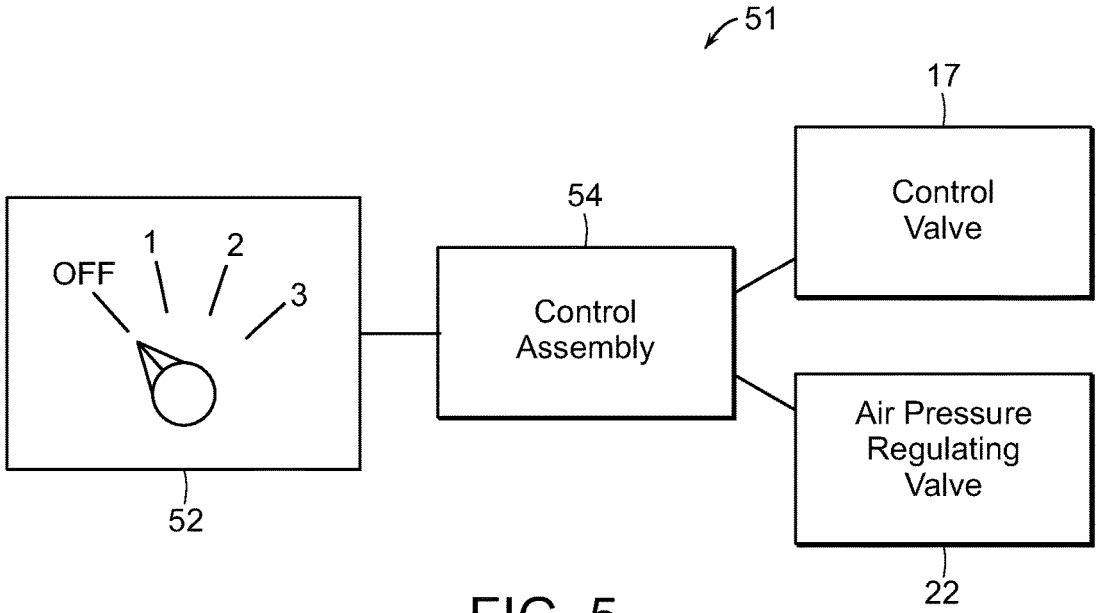
FIG. 5 is a schematic illustration of a pressure selecting assembly.

As shown schematically in FIG. 5, in certain embodiments, slurry blasting assembly 10 may be furnished with a pressure selecting assembly 51 including a selector switch 52. A user can move selector switch 52 between an off position and a plurality of preselected output pressure levels for blast stream 26. In certain embodiments these pressure levels need not be actual pressure levels, but rather may simply be relative pressure levels such as "1," "2," and "3" as seen in the illustrated embodiment. Switch 52 is connected to control valve 17 and air pressure regulating valve 22 through a control assembly 54. Once the user selects the desired output pressure level for blast stream 26, control assembly 54 sends an appropriate signal to control valve 17 and air pressure regulating valve 22, setting each of them at a pressure level required to produce the desired output pressure level for blast stream 26. Such a system makes it easier for the user to produce a limited number of preset output pressures for blast stream 26. Although the illustrated embodiment shows three preset output pressure levels, it is to be appreciated that switch 52 can be configured to produce any desired number of output pressure levels.

Figure 6:
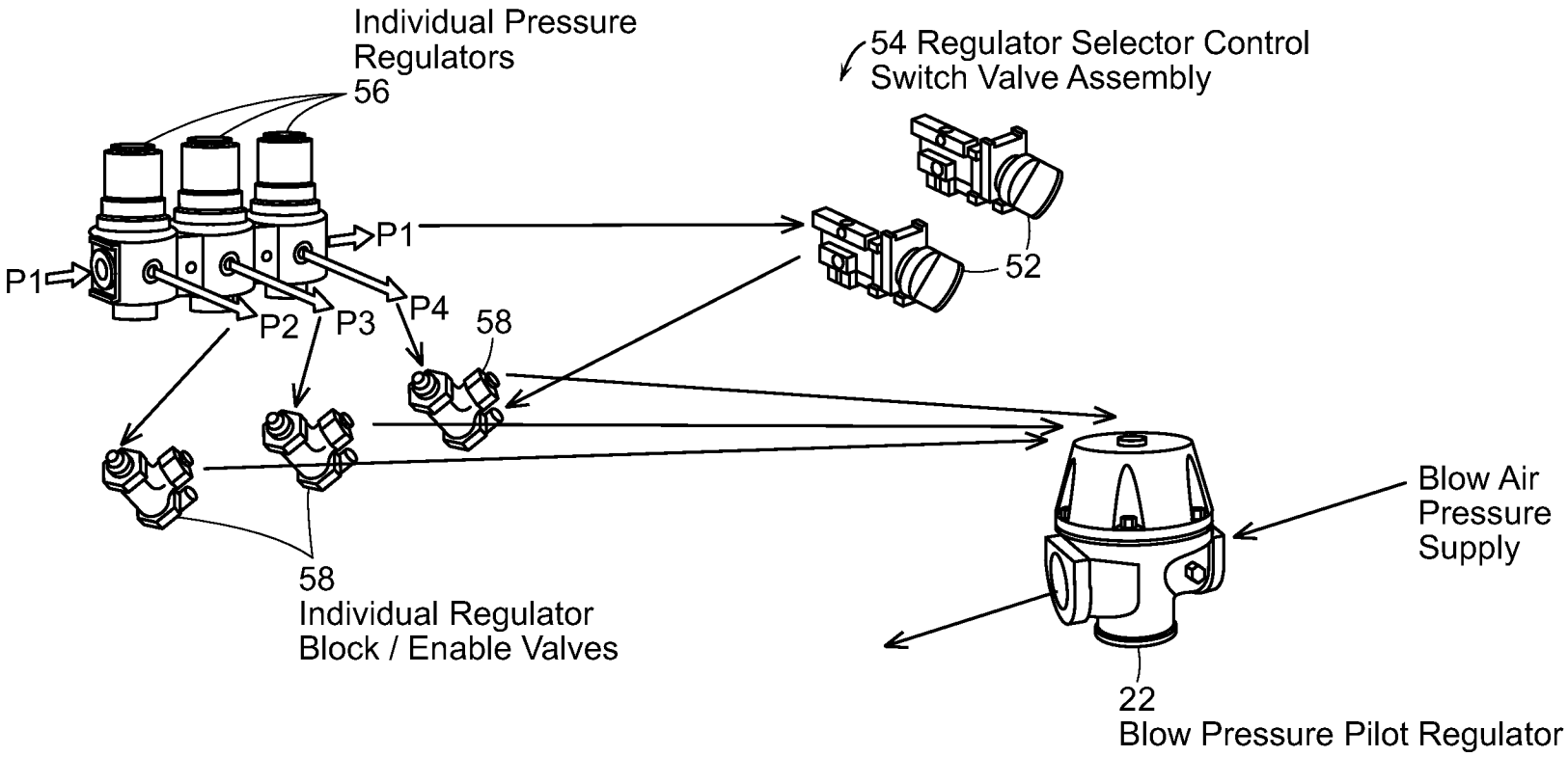
FIG. 6 is a schematic illustration of a control assembly for a pressure selecting assembly.

An exemplary control assembly 54 is seen in FIG. 6. One or more switches 52 send signals to individual pressure regulators 56 that are positioned in air piping 20. In the illustrated embodiment, there are three individual pressure regulators 56 that correspond to the three preset output pressure levels 1, 2, and 3, and that produce a preselected outlet pressure P1, P2, or P3. The selected individual pressure regulator 56 sends a signal (P1, P2, or P3) to a corresponding individual regulator block/enable valve 58, which in turn sends a signal to air pressure regulating valve 22 to produce the required air pressure for the airstream within air piping 20. Naturally, a similar control assembly controls the pressure for the slurry in blasting pot 12 through regulation of control valve 17.

Although the illustrated embodiment shows three preselected pressure levels 1, 2, and 3, it is to be appreciated that control assembly 54 can have any desired number of preset pressure levels.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of individual elements, or more than one element, from one or more described embodiment to another are also fully intended and contemplated.

What is claimed is:

1. A slurry blasting assembly comprising:

a pressurized blasting pot containing a slurry of blast media, the pot having an inlet port, a curved bottom surface, and an outlet port formed in the bottom surface;

a sweep elbow directly connected to the outlet port and the bottom surface of the pot; and an eccentric reducer, having a diameter smaller than a diameter of the sweep elbow, and directly connected to the sweep elbow;

a control valve directly connected to the eccentric reducer;

a hose shutoff having a first end and a second end, the first end being directly connected to the control valve;

a pressurized air stream from piping directly connected to the second end of the hose shutoff; and wherein the pressure of the slurry in the pot is at least two-times greater than the pressure of the air stream, wherein a diameter of the pot is 24 inches, and wherein the diameter of the sweep elbow is 6 inches.

2. The slurry blasting assembly of claim 1, wherein the pressure of the slurry in the blasting pot is about 50 psi and the air stream pressure is about 20 psi.

3. The slurry blasting assembly of claim 2, wherein the eccentric reducer transitions from a 6 inch diameter to a 2 inch diameter.

* * * * *